US007946419B1

(12) United States Patent
Stein et al.

(10) Patent No.: US 7,946,419 B1
(45) Date of Patent: May 24, 2011

(54) DETACHABLE AND CHANGEABLE MESSAGE BANDING ON NURSERY CONTAINERS

(75) Inventors: Sanford Eden Stein, Miami, FL (US); James S. Rue, Miami, FL (US); Don Salerno, Hollywood, FL (US)

(73) Assignee: One Green Thumb World, LLC, Miami, FL (US)

( * ) Notice: Subject to any disclaimer, the term of this patent is extended or adjusted under 35 U.S.C. 154(b) by 0 days.

(21) Appl. No.: 12/775,054

(22) Filed: May 6, 2010

(51) Int. Cl.
*B65D 85/00* (2006.01)
*B65D 85/50* (2006.01)
*B65D 25/00* (2006.01)

(52) U.S. Cl. ..... 206/459.5; 206/423; 220/699; 220/700

(58) Field of Classification Search ..... 206/217, 206/423, 459.5, 457; 40/234, 324, 791, 607.14; 47/66.6, 65, 86, 40.5, 44, 50, 84; 220/17.2, 220/17.3, 574, 700, 701, 699, 694, 575; 99/413
See application file for complete search history.

(56) References Cited

U.S. PATENT DOCUMENTS 2,683,974 A * 7/1954 Brown ..... 220/574.2
5,269,717 A * 12/1993 Tardif ..... 446/71
5,282,335 A * 2/1994 Holtkamp, Jr. ..... 47/81
5,325,627 A * 7/1994 Anderson ..... 47/84
5,870,856 A * 2/1999 Friend ..... 47/65.7
6,116,455 A * 9/2000 Rossman et al. ..... 220/575
6,135,307 A * 10/2000 Fahy ..... 220/574
6,564,962 B1 * 5/2003 Cheng ..... 220/574
7,367,145 B2 * 5/2008 Mou ..... 40/324
7,730,664 B2 * 6/2010 Larwood ..... 47/66.1
2004/0118022 A1 * 6/2004 Duesler ..... 40/324
2009/0194544 A1 * 8/2009 Vovan ..... 220/575

* cited by examiner

*Primary Examiner* — Mickey Yu
*Assistant Examiner* — Rafael Ortiz
(74) *Attorney, Agent, or Firm* — Albert Bordas, P.A.

(57) ABSTRACT

A detachable and changeable message banding on nursery containers, comprising a container assembly having a first sidewall that extends from a base and terminates as a lip. A band assembly has a second sidewall extending between a first top edge and a first bottom edge. The band assembly further comprises an intermediate lip inwardly extending a predetermined distance from the second sidewall. The band assembly is secured onto the container assembly. A rim assembly has a second top edge and a second bottom edge. The second bottom edge defines a top channel lip. The rim assembly mounts upon the band assembly to frame changeable messaging thereon. A removable sidewall assembly has a third sidewall extending between a third top edge and a third bottom edge. The removable sidewall assembly mounts onto the container assembly. It also comprises a base assembly.

4 Claims, 6 Drawing Sheets

DETACHABLE AND CHANGEABLE MESSAGE BANDING ON NURSERY CONTAINERS

BACKGROUND OF THE INVENTION

1. Field of the Invention

The present invention relates to containers, and more particularly, to detachable and changeable message banding for nursery containers.

2. Description of the Related Art

Many nursery containers have been designed in the past. None of them, however, comprise the novel features of the present invention for providing changeable messaging banding that is mounted within band and rim assemblies that are secured onto a nursery container assembly.

SUMMARY OF THE INVENTION

The instant invention is a detachable and changeable message banding for containers, comprising a container assembly having a first sidewall that extends from a base at a first end and terminates as a lip at a second end. A band assembly has a second sidewall extending between a first top edge and a first bottom edge. The first bottom edge defines a bottom channel lip and comprises at least one first cut out. The band assembly further comprises an intermediate lip inwardly extending a first predetermined distance from the second sidewall. The band assembly is secured onto the container assembly. A rim assembly has a second top edge and a second bottom edge. The second bottom edge defines a top channel lip and comprises at least one second cut out. The rim assembly mounts upon the band assembly to frame changeable messaging thereon. A removable sidewall assembly has a third sidewall extending between a third top edge and a third bottom edge. The removable sidewall assembly mounts onto the container assembly. The present invention further comprises a base assembly.

The container assembly mounts upon the base assembly comprising at least one protrusion. The container assembly comprises at least one recess to receive the at least one protrusion.

The lip of the first end comprises at least one aperture. The third bottom edge comprises at least one pin that aligns with and enters the at least one aperture when the removable sidewall assembly mounts onto the container assembly. The lip of the first end also comprises at least one channel. The intermediate lip comprises at least one raised rim extending a second predetermined distance that aligns with and enters the at least one channel when the band assembly is secured onto the container assembly. The bottom channel lip and the top channel lip define a bottom channel and a top channel respectively to snugly receive the changeable messaging therein.

It is therefore one of the main objects of the present invention to provide detachable and changeable message banding that is mounted within band and rim assemblies that are secured onto a nursery container assembly.

It is another object of this invention to provide detachable and changeable message banding for a nursery container, whereby the changeable messaging can be information pertaining to a nursery, or specific plant or flower contained by the present invention such as caring, watering, and fertilizer instruction, or any content desired, such as but not limited to holiday decoration, celebrations, gifts, etc.

It is another object of this invention to provide detachable and changeable message banding for a nursery container that can be readily assembled and disassembled without the need of any special tools.

It is another object of this invention to provide detachable and changeable message banding for a nursery container that is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
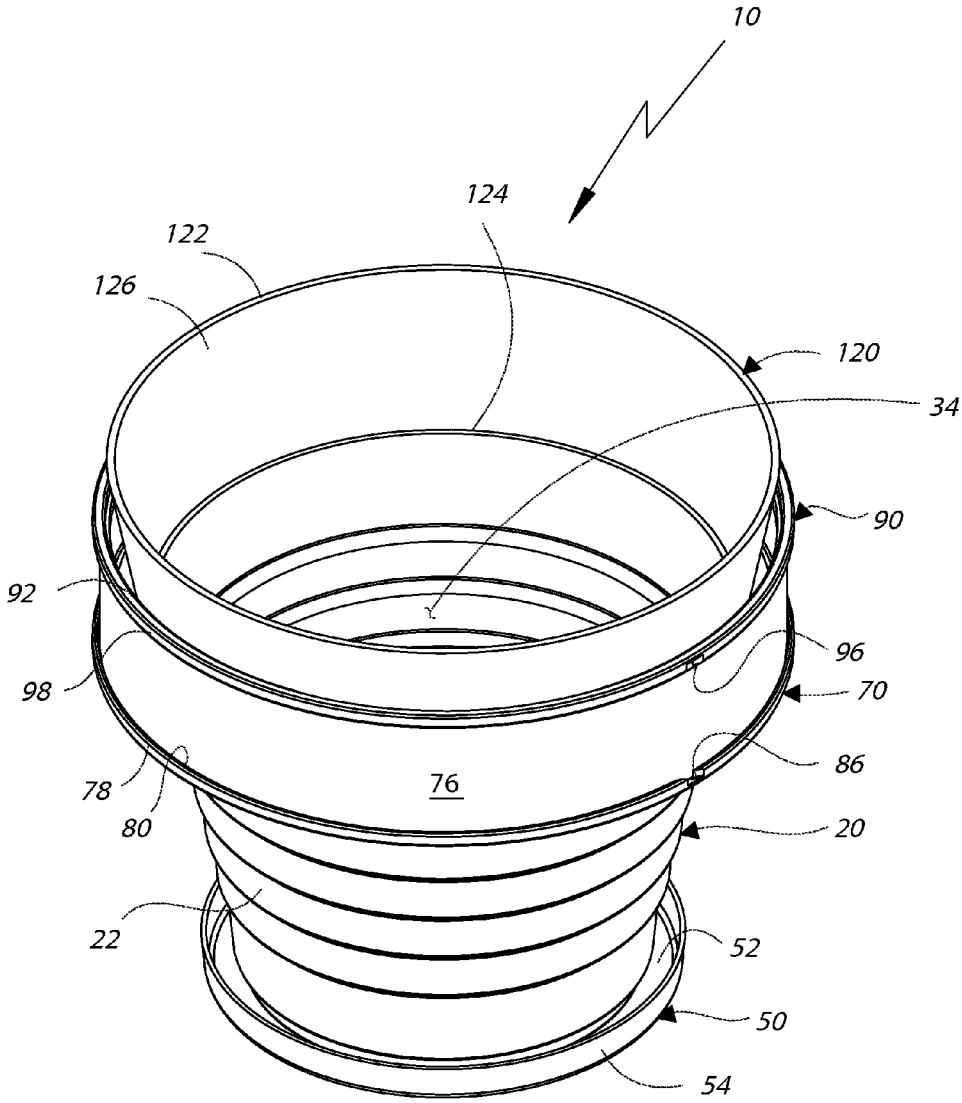
FIG. 1 is an isometric view of the present invention.

Referring now to the drawings, the present invention is a detachable and changeable message banding for nursery containers and is generally referred to with numeral 10. It can be observed that it basically includes container assembly 20, base assembly 50, band assembly 70, rim assembly 90, and removable sidewall assembly 120.

Figure 2:
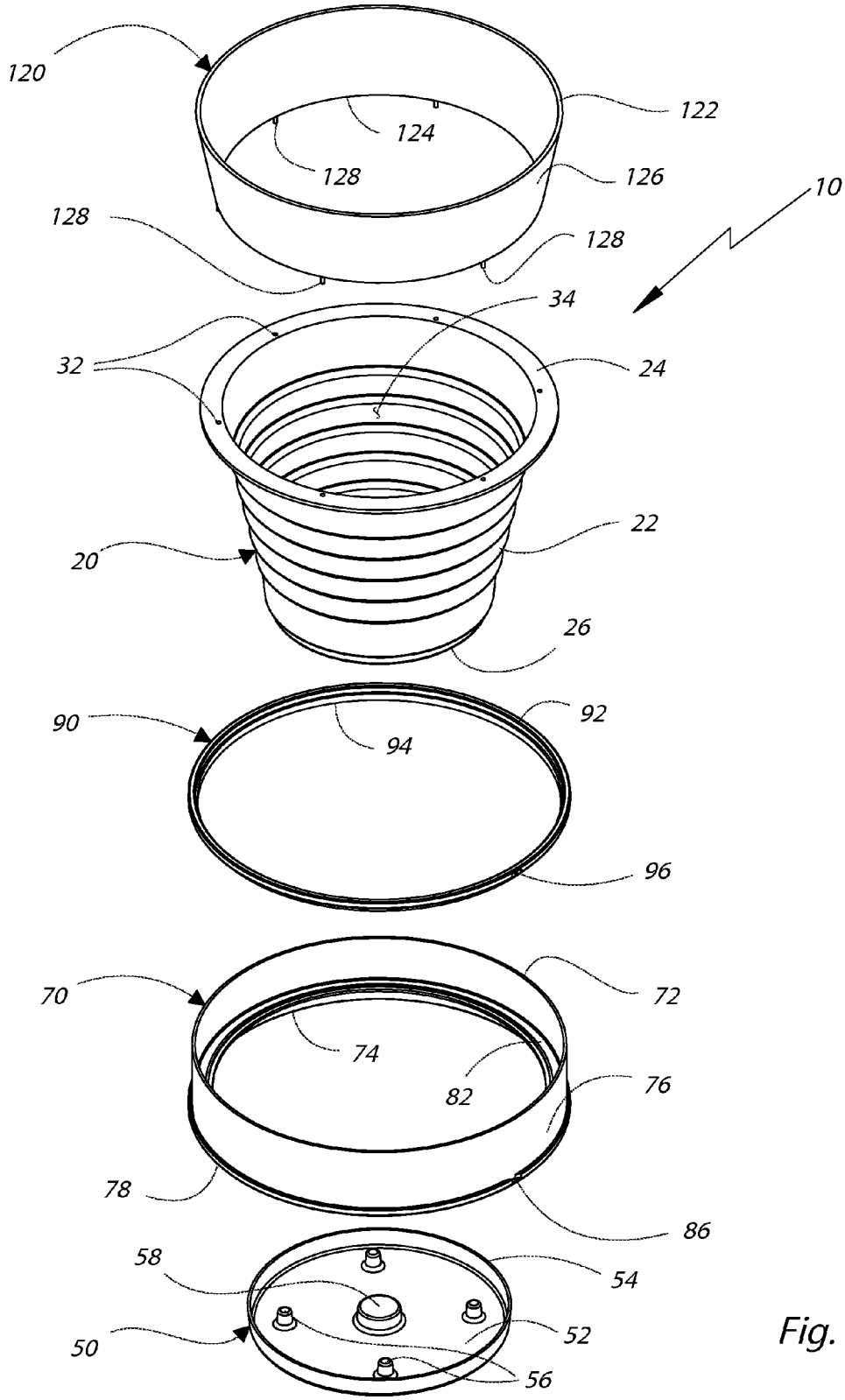
FIG. 2 is an exploded view of the instant invention.
Figure 3:
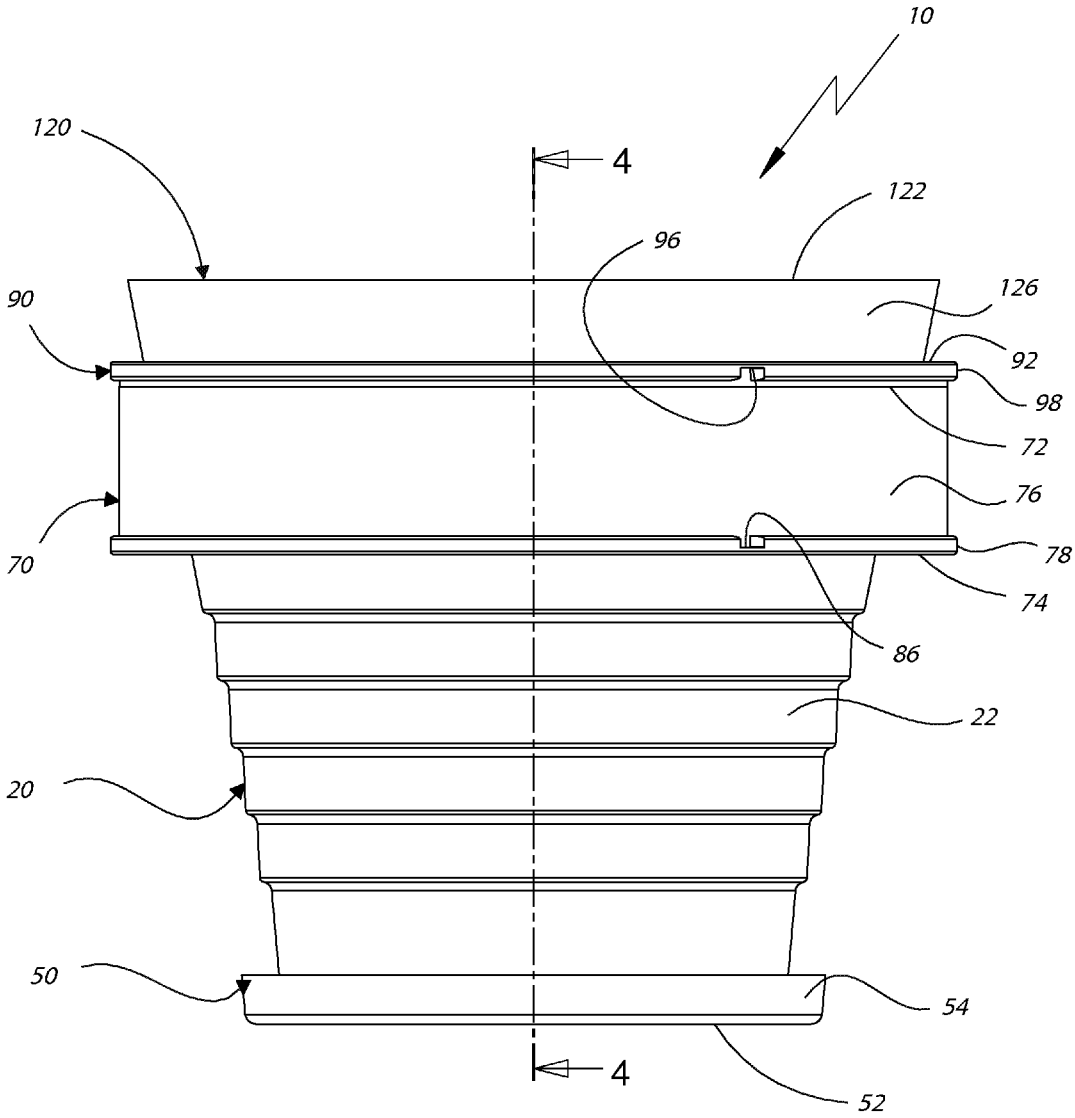
FIG. 3 is a front elevational view of the invention.

As seen in FIGS. 1, 2, and 3 present invention 10 comprises container assembly 20 having a first sidewall 22 that extends from base 26 at a first end and terminates as lip 24 at a second end. Lip 24 comprises at least one aperture 32.

Band assembly 70 has second sidewall 76 extending between first top edge 72 and first bottom edge 74. First bottom edge 74 defines bottom channel lip 78 and comprises at least one first cut out 86. Band assembly 70 further comprises intermediate lip 82 inwardly extending a first predetermined distance from second sidewall 76. Band assembly 70 is secured onto container assembly 20.

Rim assembly 90 has second top edge 92 and a second bottom edge 94. Second bottom edge 92 defines top channel lip 98 and comprises at least one second cut out 96. Rim assembly 90 mounts upon band assembly 70 to frame changeable messaging thereon. It is noted that bottom channel lip 78 and top channel lip 98 define bottom channel 80 and top channel 100 respectively to snugly receive the changeable messaging therein.

Such changeable messaging can be, as an example, information pertaining to a nursery, or specific plant or flower contained by present invention 10 within its cavity 34, such as caring, watering, and fertilizer instruction. The changeable messaging can also be any content desired, such as but not limited to holiday decoration, celebrations, gifts, etc.

Removable sidewall assembly 120 has third sidewall 126 extending between third top edge 122 and third bottom edge 124. Removable sidewall assembly 120 mounts onto container assembly 20. Third bottom edge 124 comprises at least one pin 128 that aligns with and enters at least one aperture 32 when removable sidewall assembly 120 mounts onto container assembly 20.

Figure 4:
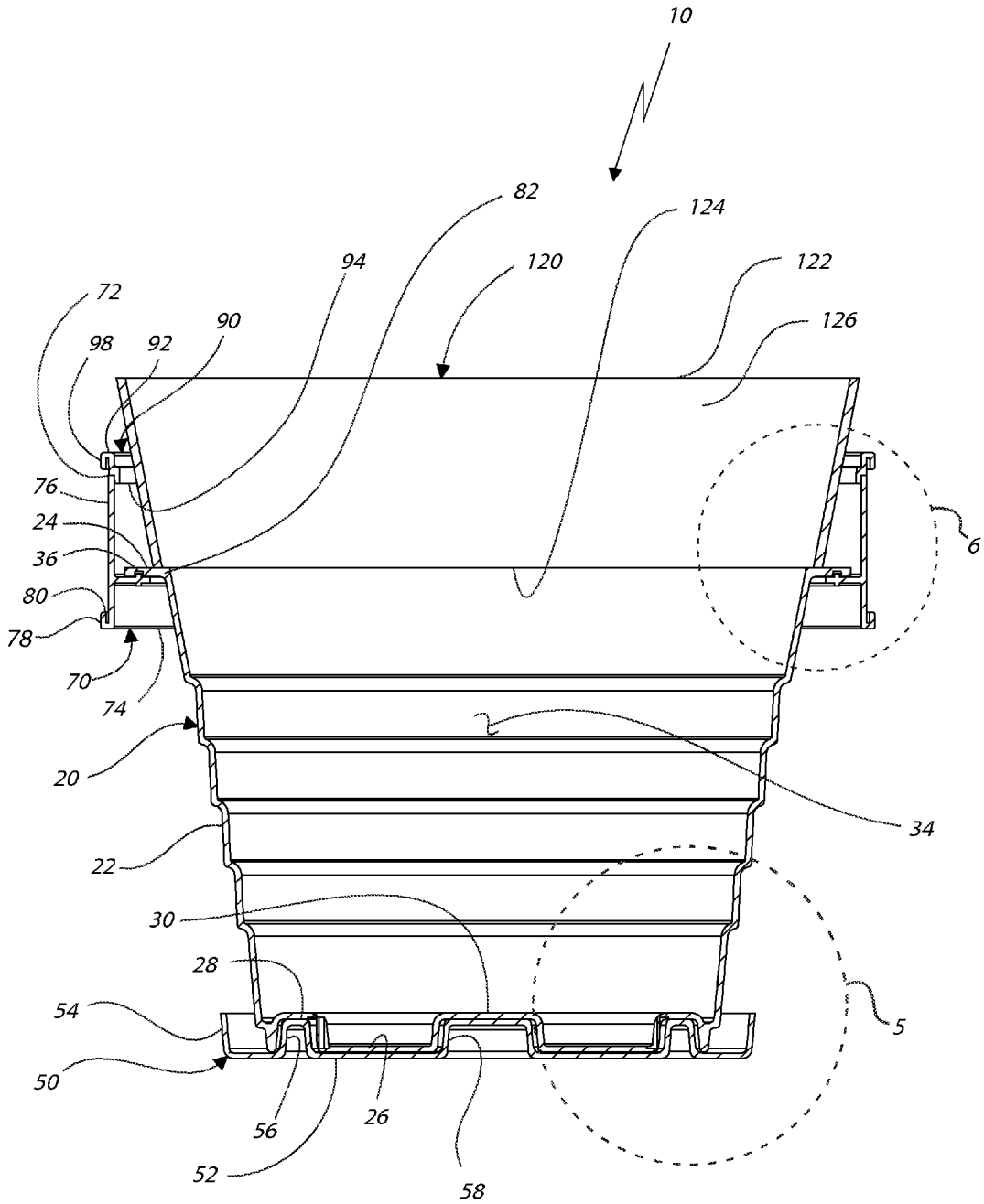
FIG. 4 is a cross sectional view taken along line 4-4 from FIG. 3.
Figure 5:
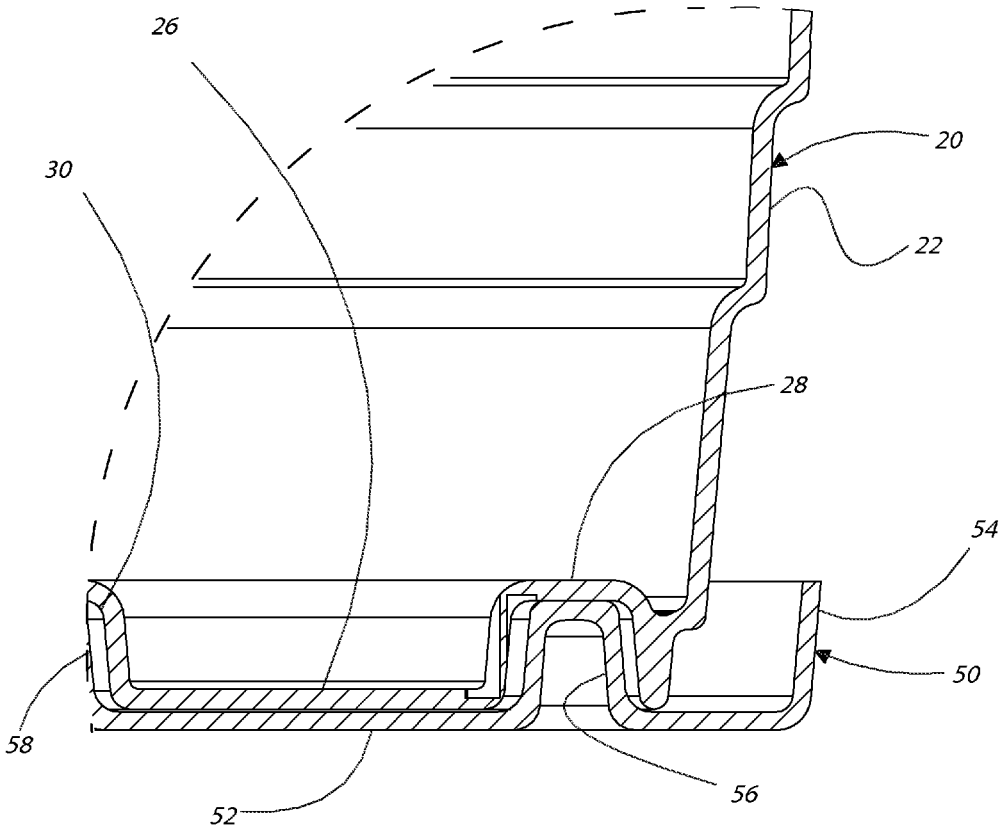
FIG. 5 is an enlarged view of a section taken along circular line 5 from FIG. 4.

As best seen in FIGS. 4 and 5, in a preferred embodiment, present invention 10 may further comprise base assembly 50 having base plate 52 and sidewall 54. Base plate 52 may comprise protrusions 56 and 58 to better receive container assembly 20 when mounted thereon, whereby container assembly 20 comprises at least one recess 28 and/or 30 to receive protrusions 56 and 58 respectively.

Figure 6:
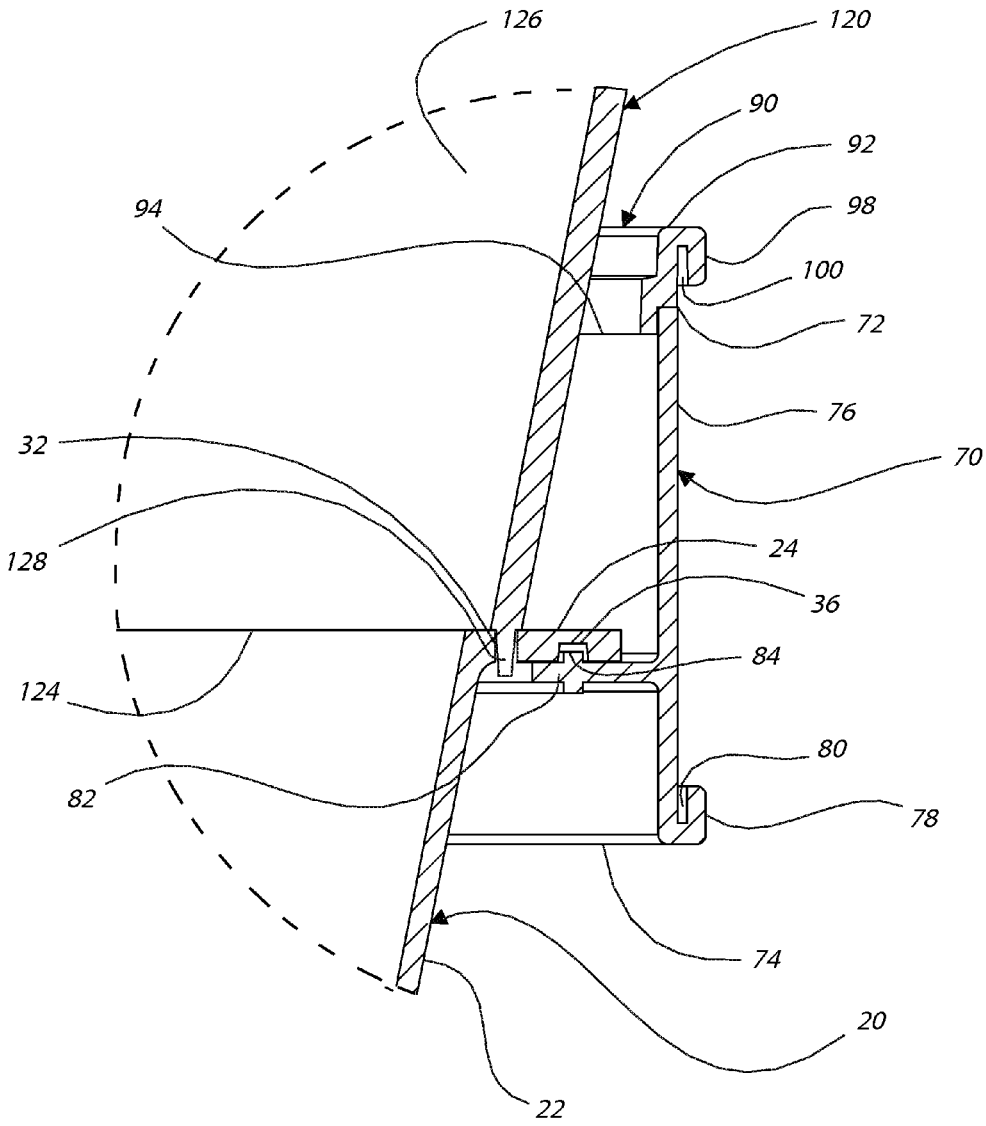
FIG. 6 is an enlarged view of a section taken along circular line 6 from FIG. 4.

As best seen in FIGS. 4 and 6, lip 24 comprises at least one channel 36. Furthermore, intermediate lip 82 comprises at least one raised rim 84 extending a second predetermined distance that aligns with and enters at least one channel 36 when band assembly 70 is secured onto container assembly 20. In a preferred embodiment, at least one raised rim 84 snaps into at least one channel 36.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A detachable and changeable message banding on nursery containers, comprising:

A) a container assembly having a first sidewall that extends from a base at a first end and terminates as a lip at a second end, said lip comprises at least one channel;

B) a band assembly having a second sidewall extending between a first top edge and a first bottom edge, said first bottom edge defines a bottom channel lip and comprises at least one first cut out, said band assembly further comprising an intermediate lip inwardly extending a first predetermined distance from said second sidewall, said band assembly is secured onto said container assembly, said intermediate lip comprises at least one raised rim extending a second predetermined distance that aligns with and enters said at least one channel when said band assembly is secured onto said container assembly;

C) a rim assembly having a second top edge and a second bottom edge, said second bottom edge defines a top channel lip and comprises at least one second cut out, said rim assembly mounts upon said band assembly to frame changeable messaging thereon;

D) a removable sidewall assembly having a third sidewall extending between a third top edge and a third bottom edge, said removable sidewall assembly mounts onto said container assembly said lip of said second end comprises at least one aperture, said third bottom edge comprises at least one pin that aligns with and enters said at least one aperture when said removable sidewall assembly mounts onto said container assembly; and E) a base assembly.

2. The detachable and changeable message banding for nursery containers set forth in claim 1, further characterized in that said bottom channel lip and said top channel lip define a bottom channel and a top channel respectively to snugly receive said changeable messaging therein.

3. The detachable and changeable message banding for containers set forth in claim 2, further characterized in that said container assembly mounts upon said base assembly comprising at least one protrusion.

4. The detachable and changeable message banding for containers set forth in claim 3, further characterized in that said container assembly comprises at least one recess to receive said at least one protrusion.

* * * * *